US006458182B2

(12) United States Patent
Shindo et al.

(10) Patent No.: US 6,458,182 B2
(45) Date of Patent: Oct. 1, 2002

(54) PROCESS FOR PRODUCING HIGH-PURITY MN MATERIALS

(75) Inventors: Yuichiro Shindo, Saitama-ken (JP); Tsuneo Suzuki, deceased, late of Saitama-ken (JP)

(73) Assignee: Japan Energy Corporation, Tokyo (JP)

( * ) Notice: Subject to any disclaimer, the term of this patent is extended or adjusted under 35 U.S.C. 154(b) by 0 days.

(21) Appl. No.: 09/742,500

(22) Filed: Dec. 21, 2000

Related U.S. Application Data

(62) Division of application No. 09/191,994, filed on Nov. 13, 1998.

(30) Foreign Application Priority Data

Nov. 18, 1997 (JP) ..... 9-332287

(51) Int. Cl.[7] ..... C22B 9/02

(52) U.S. Cl. ..... 75/588; 75/406; 75/624; 75/625; 148/424; 420/434

(58) Field of Search ..... 75/406, 588, 624, 75/625; 148/424; 420/434

(56) References Cited

U.S. PATENT DOCUMENTS 2,860,965 A * 11/1958 Ruelle et al. ..... 75/80
2,977,218 A * 3/1961 Andrieux et al. ..... 75/80
3,024,106 A 3/1962 Dean
3,926,623 A 12/1975 Keyser et al.

OTHER PUBLICATIONS

"ASM Handbook; Formerly Tenth Edition, Metals Handbook", vol. 2, ASM International Handbook Committee, Oct. 1990, pp. 1135–1138.

* cited by examiner

*Primary Examiner*—John Sheehan
*Assistant Examiner*—Andrew L. Oltmans
(74) *Attorney, Agent, or Firm*—Akin, Gump, Strauss, Hauer & Feld, L.L.P.

(57) ABSTRACT

A process for producing a high-purity Mn material comprising the steps of premelting crude Mn at 1250–1500° C. and vacuum distilling the melt at 1100–1500° C. The degree of vacuum during the vacuum distillation ranges from $5\times10^{-6}$ torr to 10 torrs. A crucible for use in the vacuum distillation is a double crucible, which consists of inner and outer crucibles, and a carbon felt packed in the space therebetween. A high-purity Mn material for thin film deposition which contains a total of not more than 100 ppm impurity metallic elements, not more than 200 ppm oxygen, not more than 50 ppm nitrogen, not more than 50 ppm S, and not more than 100 ppm C.

4 Claims, No Drawings

PROCESS FOR PRODUCING HIGH-PURITY MN MATERIALS

CROSS-REFERENCE TO RELATED APPLICATION

This application is a divisional of co-pending U.S. application Ser. No. 09/191,994, filed Nov. 13, 1998.

BACKGROUND OF THE INVENTION

This invention relates to a process for producing high-purity Mn materials and also to high-purity Mn materials for thin film deposition and its production process. More particularly, this invention relates to high-purity Mn materials which can be used as starting materials for Mn alloy materials for antiferromagnetic thin film deposition.

Magnetic recording devices such as hard disks for computers have in recent years been rapidly reduced in size and boosted in capacity. Indications are that their recording density will be as high as 20 Gb/in$^2$ in a few years. Keeping pace with the trend, reproducing heads of magnetoresistance effect (AMR) type are coming into use, supplanting the conventional induction type heads that are close to their limits of utility. The AMR heads are expected to attain rapid growth worldwide with the expansion of demand as in the personal computer market. There is a strong possibility that giant magnetoresistance effect (GMR) type heads that promise even greater densities in recording will come into practical use in years to come.

The GMR heads use spin valve membranes, and Mn alloys are drawing attention as materials for antimagnetic membranes to serve as the membranes.

As antimagnetic membranes for spin valve membranes, Mn alloys, particularly Mn-noble metal alloys, are under investigation. They are usually formed by sintering or melting. However, when commercially available electrolytic Mn is employed as the starting material for sputtering targets, melting causes bumping and spattering of molten Mn. In addition, much slags are formed, the cast ingot has a large cavity, and the yield as a target material is poor.

Sintering presents problems of abundant gas release and rather low sinter density.

Conventional alloys based on Mn too have problems of gas evolution on sputtering, production of objectionable particles, and inadequate corrosion resistance.

OBJECT OF THE INVENTION

This invention is aimed at providing means for obtaining a high-purity Mn material for targets which attain high yield and is best suited for antiferromagnetic thin film deposition so as to obtain a high-purity Mn material which contains a total of not more than 100 ppm impurity metallic elements, not more than 200 ppm oxygen, not more than 50 ppm nitrogen, not more than 50 ppm S, and not more than 100 ppm C.

SUMMARY OF THE INVENTION

After intensive research on possible solutions to the foregoing problems, the present inventors have just found that impurity metallic elements in Mn have important bearings upon the molten state of the metal and that combining premelting with vacuum distillation makes it possible to decrease those impure contents substantially. It has now been found that the high-purity Mn materials thus obtained are limited in particle generation during sputtering and are excellently corrosion-resistant.

On the basis of these findings, this invention provides:

1. A process for producing a high-purity Mn material comprising the steps of premelting crude Mn at 1250–1500° C. and then vacuum distilling the melt at 1100–1500° C.
2. A process according to 1 above, wherein the degree of vacuum during the vacuum distillation ranges from $5\times10^{-6}$ torr to 10 torrs.
3. A process according to 1 or 2 above, wherein a crucible for use in the vacuum distillation is a double crucible, which consists of an inner crucible, an outer crucible, and a carbon felt packed in the space therebetween.
4. A high-purity Mn material for thin film deposition, characterized in that it contains a total of not more than 100 ppm impurity metallic elements, not more than 200 ppm oxygen, not more than 50 ppm nitrogen, not more than 50 ppm S, and not more than 100 ppm C.
5 . A high-purity Mn material for thin film deposition, characterized in that it contains a total of not more than 50 ppm impurity metallic elements, not more than 100 ppm oxygen, not more than 10 ppm nitrogen, not more than 10 ppm S, and not more than 50 ppm C.

DETAILED DESCRIPTION OF THE PREFERRED EMBODIMENTS

The crude Mn as a starting material for the high-purity Mn material according to this invention may be a commercially available electrolytic Mn.

The crude Mn is premelted at 1250–1500° C. The premelting is carried out using a crucible of MgO, $Al_2O_3$ or the like, in an inert gas atmosphere for a holding time of at least one hour. A temperature below 1250° C. is undesirable because it does not melt Mn, as is a temperature above 1500° C. which intensifies contamination from the crucible and evaporation of Mn. A holding time of less than one hour is undesirable because it leaves part of Mn unmelted.

The premelting here is intended to remove volatile ingredients from the material.

Following the premelting, vacuum distillation is performed at 1100–1500° C. At below 1100° C. the distillation time is prolonged to excess and at above 1500° C. the evaporation rate is so high that the melt tends to catch up impurities.

The degree of vacuum for vacuum distillation ranges from $5\times10^{-6}$ to 10 torrs. If it is less than $5\times10^{-6}$ torr, no condensate will result, but if it exceeds 10 torrs Mn distillation takes too much time.

The distillation time suitably ranges from 10 to 20 minutes.

The crucible for vacuum distillation is desirably a double crucible of $Al_2O_3$ or the like. Particularly desirable is one consisting of an inner crucible and an outer crucible, with carbon felt packed in the space between the two crucibles. In the absence of carbon felt, much deposit will cover the inner wall surface of the inner crucible of $Al_2O_3$ or the like, reducing the yield of the distillate accordingly. The carbon felt packed between the inner and outer crucibles substantially decreases the deposit on the inner wall of the inner $Al_2O_3$ crucible, with a consequent increase in the yield of the distillate.

The vacuum distillation is desirably carried on until the residual amount is less than about 50% of the original amount of the charge.

The high-purity Mn material thus obtained has remarkably decreased impurity contents and is best suited as an Mn material for magnetic thin film deposition. It contains a total of not more than 100 ppm impurity metallic elements, not more than 200 ppm oxygen, not more than 50 ppm nitrogen, not more than 50 ppm S, and not more than 100 ppm C. Impurity metallic element contents are desired to be the least possible, because they deteriorate the magnetic properties and can decrease the corrosion resistance of the product. The total amount should be not more than 100 ppm, preferably not more than 50 ppm. Of other impurities, oxygen and sulfur are particularly responsible for a decrease in corrosion resistance, and therefore the oxygen content should be reduced to not more than 200 ppm, preferably not more than 100 ppm, and the sulfur content be reduced to not more than 50 ppm, preferably not more than 10 ppm.

Nitrogen and carbon are deemed not merely responsible for reduced corrosion resistance but as factors contributing to the generation of unwanted particles during sputtering. For these reasons the nitrogen content should be kept below 50 ppm, preferably below 10 ppm, and the carbon content be kept below 100 ppm, preferably below 50 ppm.

The high-purity Mn material obtained under this invention may be alloyed with another metal, e.g., Fe, Ir, Pt, Pd, Rh, Ru, Ni, Cr, or Co, to provide a material, such as a sputtering target, for magnetic thin film deposition. In such a case, needless to say, the alloying element to be combined with Mn too should be of the highest purity possible; when a commercially available product is employed it is desirably of a purity as high as 99.99% or above. When necessary, the alloying element should be freed from gaseous and volatile ingredients by vacuum degassing or other similar treatment.

The high-purity Mn material obtained as above and an alloying element other than Mn are melted together for alloying and then cast into ingot. The high-purity Mn material of this invention reduces the frequency of bumping and produces an ingot of smaller cavity than usual.

The alloy ingot thus obtained can be machined to form a sputtering target material.

The sputtering target is then used in sputtering to deposit a magnetic thin film over a substrate.

EXAMPLES

This invention is illustrated by the following examples which are not in any way limitative.

Example 1

Using an MgO crucible 1000 g of electrolytic Mn as a starting material was premelted. The atmosphere consisted of Ar.

The temperature for premelting was 1300° C. and the holding time was 5 hours.

The premelting was followed by vacuum distillation, which was carried out using an MgO double crucible.

The degree of vacuum was 0.1 torr, the temperature for distillation was 1400° C., and the holding time was 0.5 hour.

In this way, 300 g of a Mn distillate was obtained. The distilled Mn contained 120 ppm oxygen, 40 ppm nitrogen, 40 ppm S, 80 ppm C, and a total of 90 ppm metallic impurity elements.

The high-purity Mn material so obtained and 99.99%-pure Fe (containing 40 ppm oxygen,<10 ppm nitrogen,<10 ppm S, and 10 ppm C) in a ratio of 1:1 were melted in an MgO crucible at 1350° C. and held for 10 minutes, and then cast into an ingot.

The compositions of the starting materials, high-purity Mn material, and resulting Mn-Fe alloy are listed in Table 1.

TABLE 1

Example 1

| | unit: ppm | | | |
|---|---|---|---|---|
| | Mat.Mn | Dist.Mn | Mat.Fe | Mn—Fe alloy |
| Mn | bal. | bal. | 1 | 50% |
| Fe | 20 | <1 | bal. | 50% |
| O | 1000 | 120 | 40 | ta 90 |
| N | 300 | 40 | <10 | 20 |
| S | 400 | 40 | <10 | 30 |
| C | 150 | 80 | 10 | 50 |
| H | 120 | 1 | 1 | <1 |
| Pb | 35 | 1 | <1 | <1 |
| Zn | 110 | 1 | <1 | <1 |
| Si | 20 | 1 | 5 | 3 |
| Se | 10 | 5 | <1 | <1 |
| Mg | 70 | 80 | <1 | <1 |
| Sn | 10 | 1 | <1 | <1 |
| other impurities | 50 | 1 | 5 | 3 |

The bumping frequency during melting and the condition of cavity in the ingot formed by casting were visually determined.

Part of the Mn-Fe alloy so obtained was cut into a piece of about 10 mm square as a block-shaped test specimen for corrosion resistance test.

The block specimen for corrosion resistance test was mirror finished on the surface to be inspected and was placed in a wet tester kept at a temperature of 35° C. and at a humidity of 98%. 72 hours later the specimen was taken out and the surface was visually inspected for its rusting condition.

The remainder of the Mn-Fe alloy was machined to form a disk-shaped sputtering target 50 mm in diameter and 5 mm thick. The sputtering target was subjected to a sputtering test.

The number of particles 0.3 mm or larger in diameter that were found on a 3-in. wafer as a result of the sputtering was counted.

Example 2

1000 g of electrolytic Mn as a starting material was premelted using an $Al_2O_3$ crucible. The atmosphere consisted of Ar.

The temperature for premelting was 1350° C. and the holding time was 20 hours.

The premelting was followed by vacuum distillation, which was carried out using an $Al_2O_3$ double crucible. The space between the inner and outer crucibles was packed with carbon felt.

The degree of vacuum was $10^{-3}$ torr, the temperature for distillation was 1300° C., and the holding time was 0.4 hour.

In this way 250 g of a Mn distillate was obtained. The distilled Mn contained 30 ppm oxygen,<10 ppm nitrogen, <10 ppm S, 1 0 ppm C, and a total of 19 ppm metallic impurity elements.

The high-purity Mn material so obtained and 99.99%-pure Ir (containing 40 ppm oxygen,<10 ppm nitrogen,<10 ppm S, and 10 ppm C) in a ratio of 1:1 were melted in an $Al_2O_3$ crucible at 1400° C. and held for 10 minutes, and then cast into an ingot.

The compositions of the starting materials, high-purity Mn material, and resulting Mn-Ir alloy are listed in Table 2.

TABLE 2

| Example 2 | unit: ppm | | | |
|---|---|---|---|---|
| | Mat.Mn | Dist.Mn | Mat.Ir | Mn—Ir alloy |
| Mn | bal. | bal. | 1 | 50% |
| Ir | 1 | <1 | bal. | 50% |
| O | 1000 | 30 | 40 | 40 |
| N | 300 | <10 | <10 | <10 |
| S | 400 | <10 | <10 | <10 |
| C | 150 | 10 | 10 | 10 |
| H | 120 | 1 | 1 | 1 |
| Fe | 20 | <1 | <1 | 10 |
| Pb | 35 | <1 | <1 | <1 |
| Zn | 110 | <1 | <1 | <1 |
| Si | 20 | <1 | 2 | <1 |
| Se | 10 | <1 | <1 | <1 |
| Mg | 70 | <1 | <1 | <1 |
| Sn | 10 | <1 | <1 | <1 |
| other impurities | 50 | 11 | 4 | 8 |

In the same manner as described in Example 1, the bumping frequency during melting and the condition of cavity in the ingot formed by casting were visually determined. Also a corrosion resistance test was conducted simultaneously with a sputtering test done using a sputtering target fabricated in the same way.

Comparative Example 1

A 99.9%-pure material Mn (containing 1000 ppm oxygen, 200 ppm nitrogen, 400 ppm S, 300 ppm C, and a total of 710 ppm metallic impurity elements) and 99.99%-pure Fe (containing 40 ppm oxygen,<10 ppm nitrogen,<10 ppm S, and 10 ppm C) in a ratio of 1:1 were melted in an $Al_2O_3$ crucible at 1350° C., held for 10 minutes, and cast into an ingot. The compositions of the starting materials, high-purity Mn material, and the resulting Mn-Fe alloy are given in Table 3.

TABLE 3

| Comparative Example 1 | unit: ppm | | |
|---|---|---|---|
| | Mat.Mn | Mat.Fe | Mn—Fe alloy |
| Mn | bal. | 1 | 50% |
| Fe | 20 | bal. | 50% |
| O | 1000 | 40 | 500 |
| N | 200 | <10 | 150 |
| S | 400 | <10 | 200 |
| C | 300 | 10 | 160 |
| H | 120 | 1 | <1 |
| Pb | 100 | <1 | 30 |
| Zn | 110 | <1 | <1 |
| Si | 50 | 5 | 30 |
| Se | 60 | <1 | 20 |
| Mg | 70 | <1 | <1 |
| Sn | 50 | <1 | 10 |
| other impurities | 250 | 5 | 140 |

In the same manner as in Examples, the bumping frequency during melting and the condition of cavity in the ingot formed by casting were visually determined. Simultaneously with a corrosion resistance test, a sputtering test was performed using a sputtering target fabricated in the same way.

Comparative Example 2

A 99.9%-pure material Mn (containing 400 ppm oxygen, 30 ppm nitrogen, 400 ppm S, 30 ppm C, and a total of 155 ppm metallic impurity elements) and 99.99%-pure Ir (containing 40 ppm oxygen, <10 ppm nitrogen,<10 ppm S, and 10 ppm C) in a ratio of 1:1 were melted in an $Al_2O_3$ crucible at 1400° C., held for 10 minutes, and cast into an ingot. The compositions of the starting materials, high-purity Mn material, and the resulting Mn-Ir alloy are given in Table 4.

TABLE 4

| Comparative Example 2 | unit: ppm | | |
|---|---|---|---|
| | Mat.Mn | Mat.Ir | Mn—Ir alloy |
| Mn | bal. | 1 | 50% |
| Ir | 20 | bal. | 50% |
| O | 400 | 40 | 250 |
| N | 30 | <10 | 20 |
| S | 400 | <10 | 200 |
| C | 30 | 10 | 20 |
| H | 120 | 1 | <1 |
| Fe | 20 | <1 | 20 |
| Pb | 10 | <1 | <1 |
| Zn | 5 | <1 | <1 |
| Si | 40 | 2 | 20 |
| Se | 10 | <1 | 5 |
| Mg | 20 | <1 | <1 |
| Sn | 10 | <1 | 2 |
| other impurities | 20 | 4 | 12 |

In the manner described in Examples, the bumping frequency during melting and the condition of cavity in the ingot formed by casting were visually determined. Simultaneously with a corrosion resistance test, a sputtering test was performed using a sputtering target fabricated in the same way.

RESULTS

The bumping frequencies during alloy melting in Examples 1–2 and Comparative Examples 1–2 and the cavity conditions in the ingots formed on casting respectively are summarized in Table 5.

TABLE 5

| | Bumping frequency | cavity condition |
|---|---|---|
| Example 1 | low (not frequent) | small |
| Example 2 | very low | very small |
| Comp. Ex. 1 | very high | very large |
| Comp. Ex. 2 | high (frequent) | large |

The results of corrosion resistance tests conducted with the alloys of Examples 1–2 and Comparative Examples 1–2 are shown in Table 6.

TABLE 6

| | Corrosion resistance |
|---|---|
| Example 1 | good |
| Example 2 | very good |
| Comparative Example 1 | very poor |
| Comparative Example 2 | poor |

Sputtering tests were made using the sputtering targets according to Examples 1–2 and Comparative Examples 1–2, and the numbers of particles 0.3 mm or larger found after the sputtering runs were counted as shown in Table 7.

TABLE 7

| | No. of particles |
|---|---|
| Example 1 | small |
| Example 2 | very small |
| Comparative Example 1 | very large |
| Comparative Example 2 | large |

The results indicated that the process of the invention for producing a high-purity Mn material, characterized by the steps of premelting crude Mn at 1250–1500° C. and then vacuum distilling the melt at 1100–1500° C., involved only a limited frequency of bubbling during alloy melting and a small cavity in the ingot formed by alloy casting.

It was also possible by the process of the invention to obtain high-purity Mn materials for thin film deposition characterized by containing a total of not more than 100 ppm impurity metallic elements, not more than 200 ppm oxygen, not more than 50 ppm nitrogen, not more than 50 ppm S, and not more than 100 ppm C.

Further, the Mn alloys and Mn alloy sputtering targets made of the high-purity Mn materials for thin film deposition, characterized by containing a total of not more than 100 ppm impurity metallic elements, not more than 200 ppm oxygen, not more than 50 ppm nitrogen, not more than 50 ppm S, and not more than 100 ppm C, proved excellently corrosion-resistant and showed only small numbers of objectionable particles formed by sputtering.

ADVANTAGES OF THE INVENTION

The process of the invention for producing a high-purity Mn material, characterized by the steps of premelting crude Mn at 1250–1500° C. and then vacuum distilling the melt at 1100–1500° C., gives a high-purity material with only a limited frequency of bubbling during alloy melting and a small cavity in the ingot formed by alloy casting. The process thus renders it possible to improve the yield of products as sputtering target materials.

The Mn alloys and Mn alloy sputtering targets made of the materials characterized by containing a total of not more than 100 ppm impurity metallic elements, not more than 200 ppm oxygen, not more than 50 ppm nitrogen, not more than 50 ppm S, and not more than 100 ppm C, prove excellently corrosion-resistant and show only small numbers of objectionable particles formed by sputtering. They are, therefore, best suited as materials for antiferromagnetic thin film deposition.

What is claimed is:

1. A process for producing a high-purity Mn material comprising the steps of premelting an electrolytic Mn at 1250–1500° C. in an inert gas atmosphere over a holding time of at least one hour, and then vacuum distilling the resulting melt at 1100–1500° C.

2. A process according to claim 1, wherein the degree of vacuum during the vacuum distillation ranges from $5\times10^{-6}$ torr to 10 torrs.

3. A process according to claim 1, wherein a crucible for use in the vacuum distillation is a double crucible, which comprises of an inner crucible, an outer crucible, and a carbon felt packed in the space therebetween.

4. The process according to claim 2, wherein a crucible for use in the vacuum distillation is a double crucible, which comprises an inner crucible, an outer crucible, and a carbon felt packed in the space therebetween.

* * * * *